US009046273B2

(12) United States Patent
Purinton et al.

(10) Patent No.: US 9,046,273 B2
(45) Date of Patent: Jun. 2, 2015

(54) METHODS FOR OPERATING A TOP LOADING WOOD-FIRED APPLIANCE HAVING A COOPERATING TOP-LOADING DOOR AND MOVABLE BAFFLE

(75) Inventors: Roger W. Purinton, Raymond, ME (US); Shane L. Spencer, Windham, ME (US); Anthony Labelle, Saco, ME (US)

(73) Assignee: Jotul North America, Inc., Gorham, ME (US)

( * ) Notice: Subject to any disclaimer, the term of this patent is extended or adjusted under 35 U.S.C. 154(b) by 1361 days.

(21) Appl. No.: 12/685,407

(22) Filed: Jan. 11, 2010

(65) Prior Publication Data

US 2011/0168153 A1 Jul. 14, 2011

(51) Int. Cl.

| | |
|---|---|
| ***F24B 13/04*** | (2006.01) |
| ***F24C 15/28*** | (2006.01) |
| ***F24B 1/02*** | (2006.01) |
| ***F24B 1/187*** | (2006.01) |
| ***F24B 5/02*** | (2006.01) |
| ***F24B 13/00*** | (2006.01) |

(52) U.S. Cl.

CPC ..... *F24B 1/187* (2013.01); *F24B 13/04* (2013.01); *F24B 5/028* (2013.01); *F24B 13/004* (2013.01)

(58) Field of Classification Search

CPC ..... F24B 13/004; F24B 5/08; F24B 1/187

USPC ..... 110/267; 126/77

See application file for complete search history.

(56) References Cited

U.S. PATENT DOCUMENTS

| | | | | |
|---|---|---|---|---|
| 85,614 | A | 1/1869 | Sanford | |
| 141,821 | A | 8/1873 | Sexton | |
| 163,678 | A | 5/1875 | Merrill | |
| 232,457 | A | 9/1880 | Clement | |
| 617,805 | A | 1/1899 | Burns | |
| 835,915 | A | 11/1906 | Pruitt | |
| 946,701 | A | 1/1910 | Mooney | |
| 1,455,290 | A * | 5/1923 | Hieb | 126/192 |
| 1,688,430 | A | 10/1928 | Owens | |

(Continued)

FOREIGN PATENT DOCUMENTS

CA 1241883 9/1988

OTHER PUBLICATIONS

Leyden Top Loading Cast Iron Wood Stove, Travis Industries Inc., printout available online on Mar. 4, 2010, at http://www.lopistoves.com/TravisDocs/98800235.pdf, 4-pages, 2006.

(Continued)

*Primary Examiner* — Avinash Savani
*Assistant Examiner* — Deepak Deean
(74) *Attorney, Agent, or Firm* — Heslin Rothenberg Farley & Mesiti P.C.

(57) ABSTRACT

A method for operating a wood fired appliance, in one aspect, generally includes automatically moving a baffle to a lowered closed position from the raised open position in response to a top loading door being moved to a closed position to close the opening in a top wall. The baffle may also be automatically inhibited from being maintained in the raised opened position when the top loading door is disposed in the closed position. For example, a cam may be tripped or activated by lowering of the top loading door to cause the baffle to rotate about an axis and fall under the force of gravity to the lowered closed position, and the cam may inhibit the baffle from being raised when the top loading door is closed.

31 Claims, 10 Drawing Sheets

(56) References Cited

U.S. PATENT DOCUMENTS

| | | | | | |
|---|---|---|---|---|---|
| 1,804,988 | A | | 5/1931 | Howe | |
| 2,174,347 | A | | 9/1939 | Card | |
| 2,196,467 | A | | 4/1940 | Masonick | |
| 2,348,933 | A | * | 5/1944 | Seeley | 126/73 |
| 2,352,057 | A | | 6/1944 | Wingert | |
| 2,378,114 | A | * | 6/1945 | Van Donk | 312/276 |
| 2,438,123 | A | | 3/1948 | Lambert et al. | |
| 2,443,910 | A | * | 6/1948 | Higley | 126/83 |
| 2,444,402 | A | * | 6/1948 | Klein | 126/287 |
| 2,461,068 | A | | 2/1949 | Lockwood | |
| 2,564,713 | A | | 8/1951 | Miles | |
| 2,781,039 | A | | 2/1957 | Kaiser et al. | |
| 3,322,417 | A | | 5/1967 | Mitchell | |
| 4,154,212 | A | | 5/1979 | Wilkinson | |
| 4,192,285 | A | | 3/1980 | Nietupski | |
| 4,252,104 | A | * | 2/1981 | Morris | 126/5 |
| 4,263,889 | A | | 4/1981 | Martenson | |
| 4,280,476 | A | | 7/1981 | Webb | |
| 4,319,556 | A | | 3/1982 | Schwartz et al. | |
| 4,337,753 | A | | 7/1982 | McGinn | |
| 4,338,913 | A | * | 7/1982 | Good | 126/77 |
| 4,362,146 | A | | 12/1982 | Schuller | |
| 4,373,507 | A | | 2/1983 | Schwartz et al. | |
| 4,424,799 | A | | 1/1984 | Patterson | |
| 4,430,986 | A | | 2/1984 | Thalis | |
| 4,432,335 | A | | 2/1984 | Kilham | |
| 4,458,662 | A | | 7/1984 | Barnett | |
| 4,466,419 | A | * | 8/1984 | Syme | 126/4 |
| 4,467,778 | A | * | 8/1984 | Babbage et al. | 126/77 |
| 4,499,889 | A | | 2/1985 | Syme | |
| 4,510,917 | A | | 4/1985 | Runquist | |
| 4,580,546 | A | | 4/1986 | Barnett | |
| 4,582,045 | A | | 4/1986 | Dorau et al. | |
| 4,651,709 | A | | 3/1987 | Schnetker | |
| 4,665,889 | A | | 5/1987 | Rumens et al. | |
| 4,694,820 | A | | 9/1987 | Buckner | |
| 4,708,123 | A | | 11/1987 | Strnad | |
| 4,766,876 | A | | 8/1988 | Henry et al. | |
| 4,856,491 | A | * | 8/1989 | Ferguson et al. | 126/77 |
| 5,050,579 | A | | 9/1991 | Melton et al. | |
| 5,113,843 | A | | 5/1992 | Henry et al. | |
| 5,186,385 | A | | 2/1993 | Karabin et al. | |
| 5,341,794 | A | * | 8/1994 | Henry et al. | 126/77 |
| 5,435,377 | A | | 7/1995 | Kratochvil | |
| 6,035,812 | A | | 3/2000 | Harrigill et al. | |
| 6,688,302 | B2 | * | 2/2004 | Henry et al. | 126/77 |
| 7,004,751 | B2 | | 2/2006 | Malloy et al. | |
| 7,216,645 | B2 | * | 5/2007 | Henry et al. | 126/77 |
| 2005/0279344 | A1 | * | 12/2005 | Cyris | 126/193 |

OTHER PUBLICATIONS

Shelton, Jay, Solid Fuels Encyclopedia, A Garden Way Book, cover page and p. 99, 1982.

Hearth & Home, Buyer's Guide 2000-2001, 2 pages, Jul. 2000.

* cited by examiner

METHODS FOR OPERATING A TOP LOADING WOOD-FIRED APPLIANCE HAVING A COOPERATING TOP-LOADING DOOR AND MOVABLE BAFFLE

FIELD OF THE INVENTION

This invention relates generally to methods for operating wood fired appliances, and more specifically, to methods for operating wood fired appliances having a cooperating top loading door and movable baffle.

BACKGROUND OF THE INVENTION

Prior to EPA particulate emissions regulations for wood heaters, established the late 1980's, numerous models of conventional wood stoves enjoyed the sales benefit of the convenience feature of being capable of fueling by way of a top loading door.

Consequently, in order to comply with EPA regulations, many manufacturers opted for utilizing a non-catalytic secondary combustion design. This typically employed what is commonly known as a "Scandinavian" baffle in combination with a secondary air source directly below the baffle to achieve low particulate emissions performance, or "clean burn." These non-catalytic woodstoves employ a fixed position horizontal or near horizontal Scandinavian baffle and a series of tubes or a manifold to supply diffused secondary air directly beneath the baffle to provide for the "clean burn" characteristic. Scandinavian baffle designs, however, do not allow for fuel to be loaded through a top door to the firebox as the baffle effectively blocks vertical delivery to the firebox by impeding a majority of access to the firebox fuel holding area.

Woodstoves incorporating Scandinavian, or horizontal baffles, have an extended flame path which promotes cooler stack temperatures with the benefit of minimized flue gas temperature entering the chimney. The cooler stack temperature allows closer installation clearances to combustibles (adjacent walls and structure) in comparison to other typical top loading non-catalytic technology currently available and of comparable energy output.

In the past several years there have been introductions of non-catalytic designs featuring a top loading door. The majority of currently available, non-catalytic wood heaters with top loading door capability incorporate a secondary combustion or "down drafting" firebox system and a bypass damper at the flue entrance. Down drafting does not employ a baffle but instead the bypass damper or bypass gate directs the products of primary combustion downward through the coal bed into an entrance to a secondary combustion chamber located behind the firebox. The hot gases are exposed to a secondary air source in the secondary combustion chamber to achieve low emissions performance. Consequently, the lack of a secondary baffle in these systems allows for a top loading feature. In order to refuel the non-catalytic wood heaters with top loading door, the bypass gate must be opened allowing a straight path to the chimney, otherwise large amounts of combustion products would enter the room should the fuel load door be opened.

An example, of a wood burning stove having a top loading door and down-draft combustion is the LEYDEN top loading cast iron wood stove available from Lopi Fireplace and manufactured by Travis Industries.

U.S. Pat. Nos. 6,688,302 and 7,216,645 issued to Henry et al. disclose a wood burning stove having a manually operated top loading door and a manually operated movable baffle. The baffle is movable to a position behind the opening when the top loading door is opened for loading the wood burning stove and for directing combustion gas behind the opening in the stove and out the chimney. The lower portion of the baffle is disposed in the combustion chamber when the baffle is in the open position. In addition, the lower portion of the baffle is also maintained in the combustion chamber when moving the baffle to the closed position to the open position.

There is a need for further methods for operating wood fired appliances, and more specifically, to methods for operating wood fired appliances having a cooperating top loading door and movable baffle.

SUMMARY OF THE INVENTION

In a first aspect, the present invention provides a method for operating a wood fired appliance to produce heat. The method includes exhausting gas from a combustion chamber past a bottom surface of a baffle disposed in a raised open position, below an open first opening in a top wall, and out a flue, loading wood through the first opening, past the raised baffle, and into the combustion chamber, automatically moving the baffle to a lowered closed position from the raised open position in response to a top loading door being moved to a closed position to close the opening in the top wall, automatically inhibiting the baffle from being maintained in the raised opened position when the top loading door is disposed in the closed position, and exhausting gas from the combustion chamber between a top surface of the baffle disposed in the lowered closed position and a bottom surface of the top loading door disposed in the closed position, and out the flue.

In a second aspect, the present invention provides a method for operating a wood fired appliance to produce heat. The method includes exhausting gas from a combustion chamber past a bottom surface of a baffle disposed in a raised open position, below an open first opening in a top wall, and out a flue, loading wood through the first opening, past the raised baffle, and into the combustion chamber, moving a top loading door to a closed position to close the first opening in the top wall to engage a cam and rotate the baffle about an axis past a center vertical position so that the baffle falls under the force of gravity to a lowered closed position, inhibiting the baffle with the cam from being rotated about the axis past the center vertical position to the raised open position when the top loading door is disposed in the closed position, and exhausting gas from the combustion chamber between a top surface of the baffle disposed in a lowered closed position and a bottom surface of the top loading door disposed in the closed position, and out the flue.

In a third aspect, the present invention provides a method for operating a wood fired appliance to produce heat. The method includes providing the wood fired appliance having a housing, a top loading door movable between an open position to permit access to a first opening and a closed position to cover the first opening, and a movable baffle disposed below the first opening, exhausting gas from a combustion chamber in the housing between a top surface of the baffle and a bottom surface of the top loading door disposed in a closed position, and out the flue, opening the top loading door to access the first opening, moving the baffle to the raised open position from a lowered position to define a second opening in fluid communication with the flue, exhausting gas from the combustion chamber through the second opening, below the open first opening, and out the flue, loading wood into the combustion chamber, closing the top loading door to cover the first opening, tripping the baffle, via the closing of the top loading door, to fall under the force of gravity to a lowered closed position from the raised open position, and inhibiting the baffle from being maintained in the raised open position when the top loading door is disposed in the closed position.

In a fourth aspect, the present invention provides a method for operating a wood fired appliance to produce heat. The method comprising providing the wood fired appliance comprising a housing having a combustion chamber therein and a top wall, a movable top loading door for covering an opening in the top wall of the housing, a rotatable baffle having an end pivotally attached to the housing and rotatable about an axis, the baffle positionable in a lowered generally horizontal closed position below and spaced-apart from the opening in the top wall to define a first passageway for directing exhaust gas from a front of the housing between a top of the baffle and a bottom of the top loading door, and out a flue, and rotatable to a raised past center vertical position to define an opening for loading wood into the combustion chamber and for directing exhaust gas from the combustion chamber through the opening and out the flue, a cam pivotally attached to the housing, the cam comprises a upper leg and a lower leg, the lower leg engagable with an upper end portion of the baffle, and the upper leg being disposed above the top wall when the baffle is disposed in the raised open position and engagable with the lower leg, and wherein the upper leg of the cam is engagable with the top loading door for lowering the rotatable baffle to the lowered closed position from the raised open position when the top loading door is lowered to cover the opening in the top wall of the housing. The top loading door is opened and a baffle is moved to the raised open position from the lowered closed position. Wood is loaded into the combustion chamber and the top loading door is closed. A first arm of a cam engages the top loading door to cause a second arm of the cam to move the baffle from the raised open position to the lowered closed position under the force of gravity to cover the opening to the combustion chamber. Gas is exhausting from the combustion chamber between a top surface of the baffle and a bottom of the top loading door, and out the flue.

In a fifth aspect, the present invention provides a method for operating a wood fired appliance to produce heat. The method includes providing the wood fired appliance having a housing, a top loading door movable between an open position to permit access to a first opening and a closed position to cover the first opening, and a movable baffle disposed below the first opening, and exhausting gas from a combustion chamber in the housing between a top surface of the baffle and a bottom surface of the top loading door disposed in a closed position, and out the flue. The top loading door is opened to access the first opening, and the baffle is moved to the raised open position from a lowered position to define a second opening in fluid communication with the flue. The baffle is disposed substantially away from the combustion chamber in the when in the raised open position and in the lowered closed position. Gas is exhausted from the combustion chamber through the second opening, below the open first opening, and out the flue. Wood is loaded into the combustion chamber, the top loading door is closed to cover the first opening, and then the baffle is closed.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
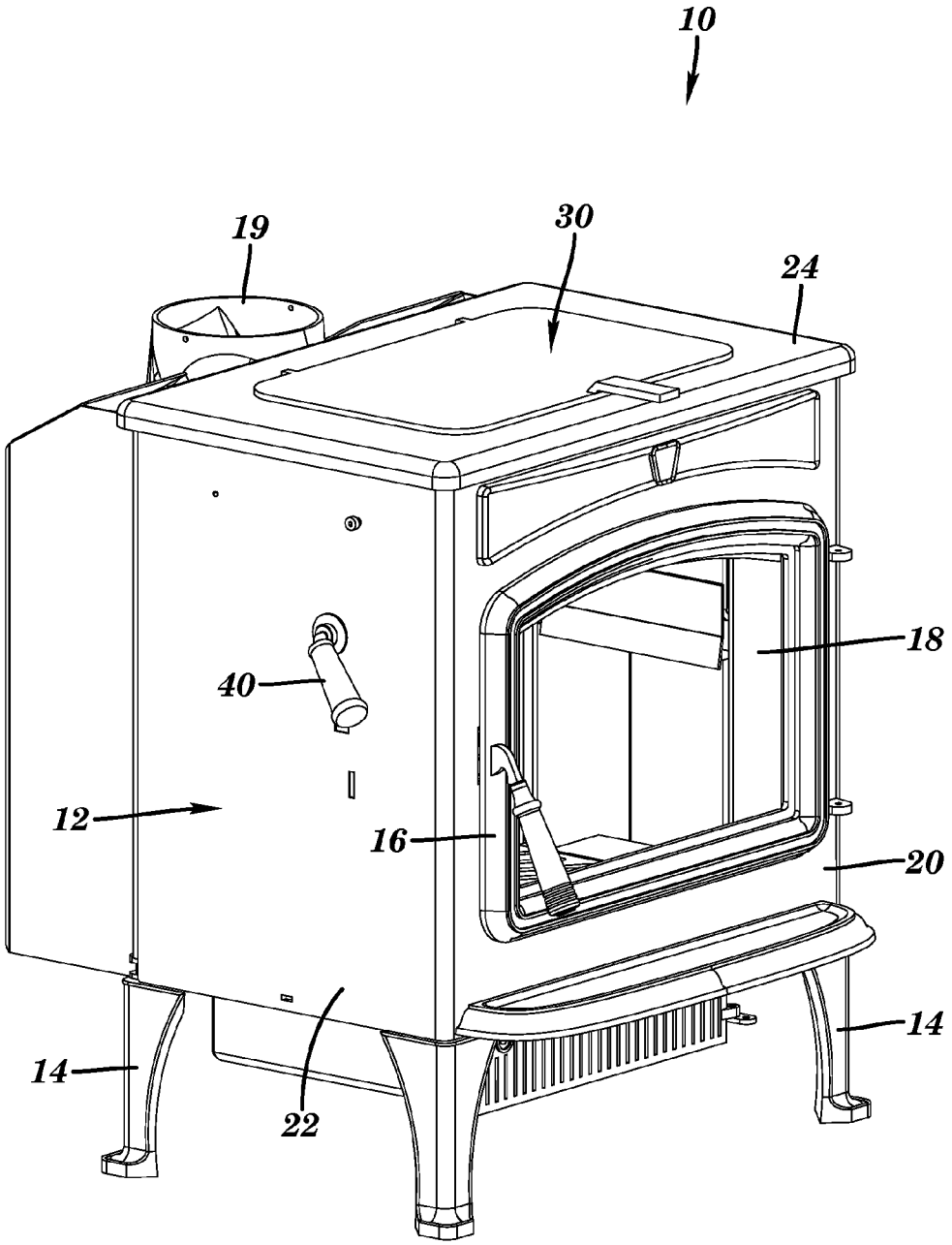
FIG. 1 is a perspective view of a wood fired appliance, having a top loading door and a movable baffle, in accordance with the present invention, with the top loading door disposed in a lower closed position.

The present invention is generally directed to methods for operating a top loading wood fired appliances having a Scandinavian-style baffle configuration. In one aspect, the method for operating a wood fired appliance generally includes a cooperating top loading door and movable baffle. For example, method for operating a wood fired appliance may include automatically moving a baffle to a lowered closed position from the raised open position in response to a top loading door being moved to a closed position to close the opening in a top wall. The baffle may also be automatically inhibited from being maintained in the raised opened position when the top loading door is disposed in the closed position. For example, as described in greater detail below, a cam may be tripped or activated by lowering the top loading door to cause the baffle to rotate about an axis and fall under the force of gravity to the lowered closed position. The cam may also inhibit the baffle from being raised when the top loading door is closed. This technique inhibits, if not prevents, the likelihood of the baffle remaining in a raised open position after the loading wood in the wood fired appliance via the top, and closing a top loading door. One advantage of the present invention in inhibiting the baffle from remaining in a raised open position is that it allows for closer clearance installation compared to movable baffles that may inadvertently remain in an raised open configuration which results in hotter combustion gases being exhausted directly out the flue.

It will also be appreciated that the present invention provides for top load door fueling of a non-catalytic wood fired heater employing a Scandinavian style baffle, and accomplished by way of the baffle rotating about an axis from a horizontal or near horizontal position to a past center vertical position. For example, utilizing the front secondary air tube as an axis, allows the baffle to be substantially rotated out of the way, if not entirely out of the way, from accessing the combustion chamber, to facilitate loading fuel into the combustion or firebox chamber via the top load door. The cam lever or interlock mechanism returns the baffle to the original resting horizontal or near horizontal "clean burn position" when the top load door is closed. The cam lever or interlock mechanism operates on a axial cam lever function between the rotating baffle and the top load door to assure that the baffle returns to the horizontal or near horizontal position when the top load door is closed by way of weighted leverage transferred through the cam lever mechanism to the baffle. The cam or interlock mechanism also inhibits the baffle, by means of center of gravity orientation, from being positioned in the vertical or open position when the top load door is closed. With the baffle returning to the clean burn position and automatically inhibited, if not prevented, from remaining in the raised position when the top loading door is closed, the exhaust and flame path length is maximized resulting in minimized flame extension and reduction of high temperature flue gas exiting the flue outlet and entering the chimney connector.

FIG. 1 illustrates one embodiment of a wood fired appliance 10 such as a vented wood fireplace heater in accordance with the present invention. Wood fired appliance 10 generally includes a housing 12 supported by a plurality of feet 14, a door 16 having a glass panel 18, and a top loading door 30 which is shown in a lowered closed position. Housing 12 may include a front wall 20 having an opening which is covered by door 16, a pair of sidewalls 22 (only one of which is shown in FIG. 1), a top wall 24, and a rear wall and bottom wall (not shown in FIG. 1). A flue 19 in fluid communication with the inside of the housing may be operably connected to a chimney in a building such as a home.

Figure 2:
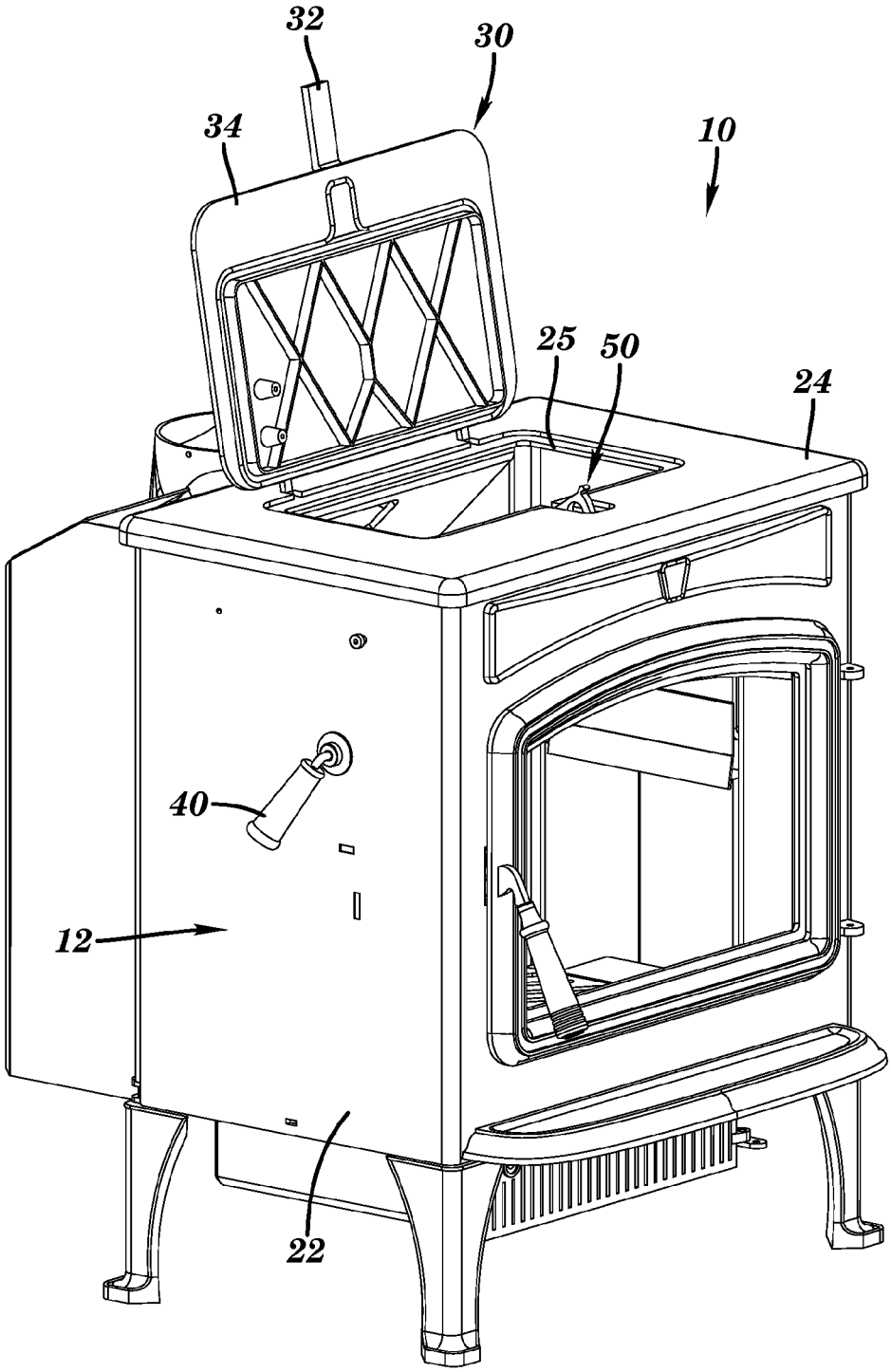
FIG. 2 is a perspective view of the wood fired appliance of FIG. 1 with the top loading door disposed in a raised opened position.
Figure 3:
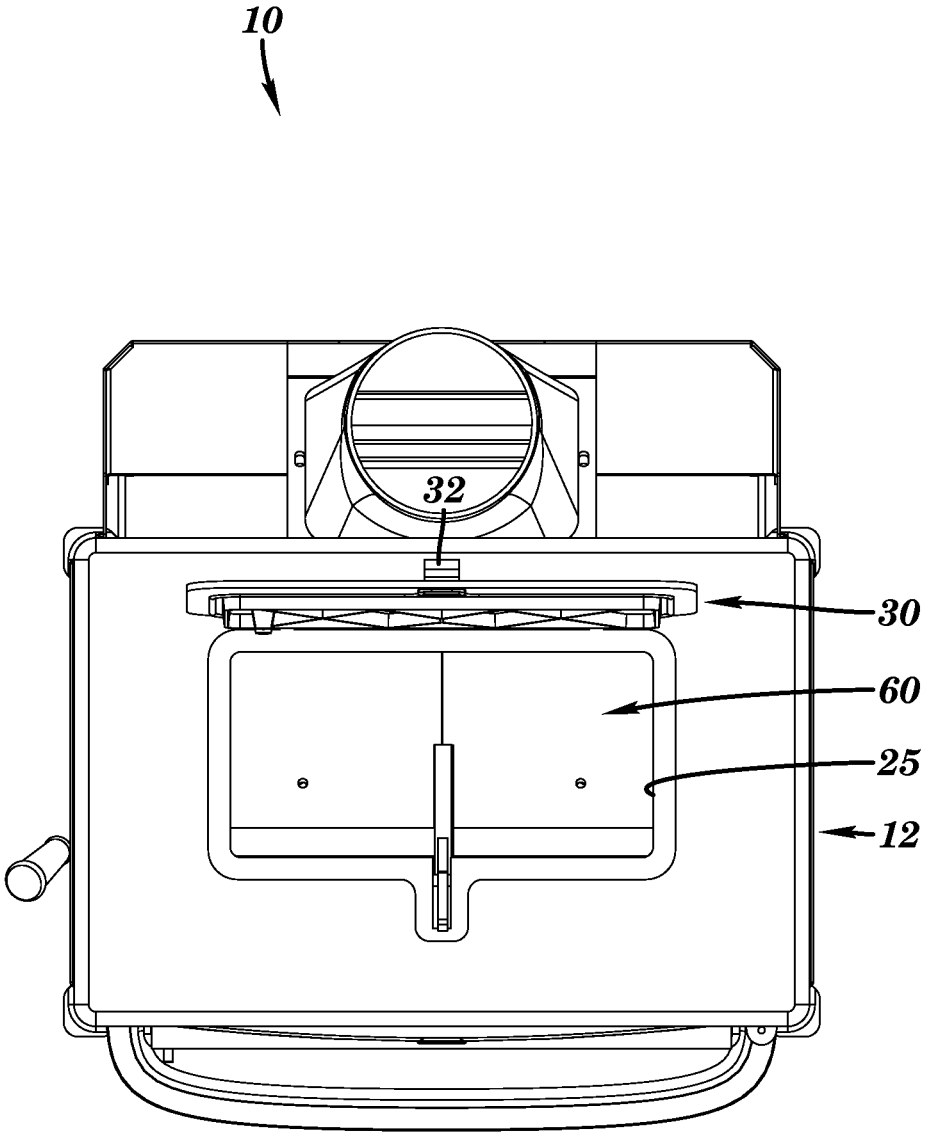
FIG. 3 is a top view of the wood fired appliance of FIG. 1 with the top loading door disposed in an open position and the baffle disposed in a lowered closed position.
Figure 4:
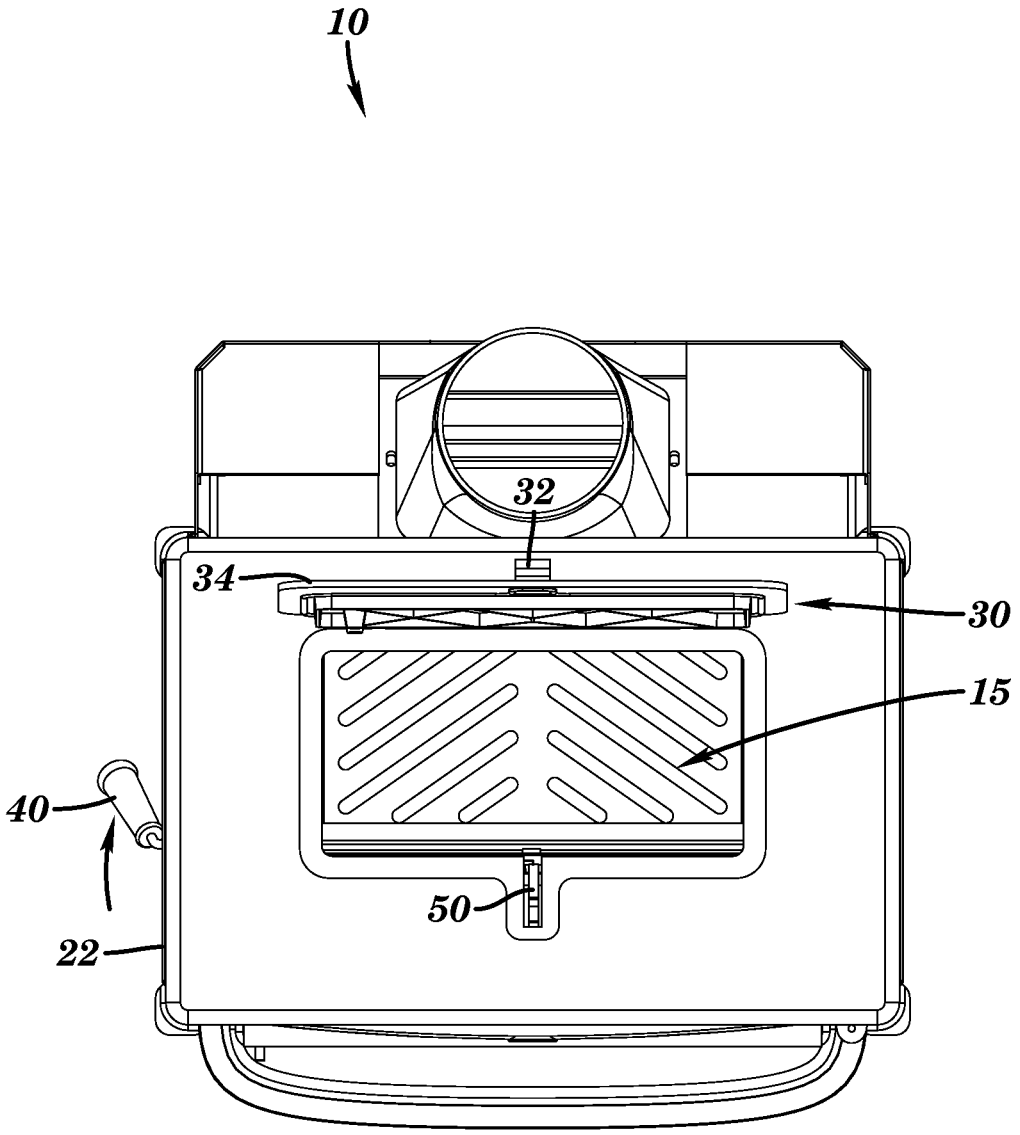
FIG. 4 is a top view of the wood fired appliance of FIG. 1 with the top loading door disposed in a raised open position and the baffle disposed in a lowered closed position.

FIG. 2 illustrates wood fired appliance 10 in a loading configuration for loading wood into a combustion chamber in housing 12. For example, an operator may raise top loading door 30 using a handle 32 to access an opening 25 in top wall 24 with, as shown in FIG. 3, a baffle 60 being initially disposed in a closed position. After opening the top loading door 30, as shown in FIG. 4, the operator may also operate a handle 40 e.g., disposed along side 22 of housing 20, to raise the baffle (not shown in FIG. 4), to access a combustion chamber 15 in the housing from above. In addition, the raised baffle redirects the flow of exhaust gas when loading wood in the wood fired appliance as described in greater detail below. It will be appreciated that the baffle may be moved at the same time as opening the top loading door or just before opening the top loading door.

After loading wood in wood fired appliance 10, an operator may use handle 32 to lower top loading door 30. Upon an operator lowering top loading door 30, a front edge portion 34 of top loading door 30 engages a portion of a raised cam 50 to trip or automatically cause the baffle (not shown in FIG. 2) to be moved to its lowered position as described in greater detail below. It will also be appreciated that the wood fired appliance may be loaded with wood from the front of the housing via door 16.

Figure 5:
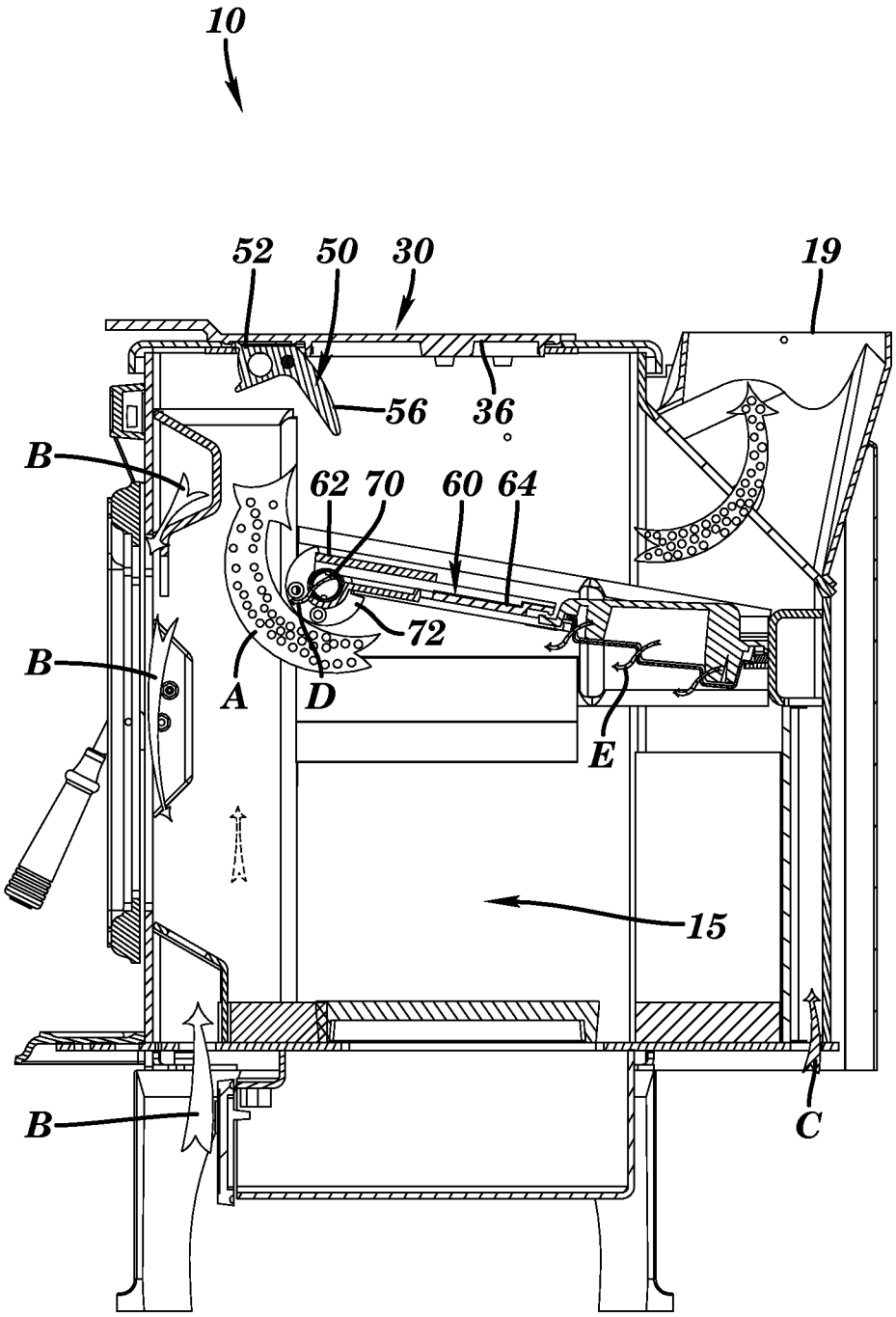
FIG. 5 is a cross-sectional view of the wood fired appliance of FIG. 1 with the top loading door and baffle disposed in a lowered closed position.

FIG. 5 is a cross-sectional view of wood fired appliance 10 with top loading door 30 disposed in a lowered closed position and a baffle 60 for regulating the flow of air within the housing disposed in a lowered closed position (generally extending the width of the housing) above combustion chamber 15 for burning wood (not shown). Baffle 60 may be a rotatable baffle or plate having a first end 62 pivotally supported on the sidewall of housing 12 and rotatable about an axis. For example, a front secondary air tube 70 may be used as an axis about which the baffle is rotatable. The axis may be disposed below a front portion of the opening in top wall 24. The ends of secondary air tube 70 may be pivotally supported along the inside of housing 12 via a pair of mounting brackets 72 (only one of which is shown in FIG. 3). Mounting brackets 72 may have an inner curved surface for supporting the end of secondary air tube 70. The secondary air tube receives air from an internal channel, e.g., through one or both of its ends, and delivers the air above the combustion chamber for burning in a secondary combustion area below the baffle and in front of the baffle, e.g., burning of carbon monoxide (CO) and organic particulate matter.

It will be appreciated that other suitable means for supporting the baffle and allowing it to be rotated may be employed. Handle 40 (FIGS. 1 and 2) may be connected to a solid rod extension connected to secondary air tube 70 concentric to the axis of rotation which passes or extends though sidewall 22 of housing 12 for allowing an operator to move the handle and the baffle to a raised position. It will be appreciated that instead of a secondary air tub, a pair of pins or a rod may be attached to first end 62 of baffle 60 for allowing baffle 60 to be rotated. The baffle in its lowered closed position includes side edges that generally extend between and rest on fixed horizontal baffles attached to the sidewalls of the housing (which fixed horizontal baffles may also attach to the rear secondary air manifold), a rear edge portion which rests on the secondary air manifold extending from the rear wall of the housing, and a front edge portion that is spaced-apart from the front side wall.

The baffle is positionable in a lowered generally horizontal position below and spaced-apart from the closed top loading door 30 and the opening in top wall 24. With the baffle in the lowered closed position, a first passageway is defined for directing exhaust gas from combustion chamber 15 toward a front of housing 12 and between a top surface 64 of baffle 60 and a bottom surface 36 of top loading door 30 (as represented by arrow A), and then out flue. The paths for introduction of primary air for combustion are illustrated by arrows B, and a path for introduction of secondary air for combustion is illustrated by arrow C, D, and E. Also observed in FIG. 5, the front portion of top loading door 30 rests on a leg 52 of cam 50.

Figure 6:
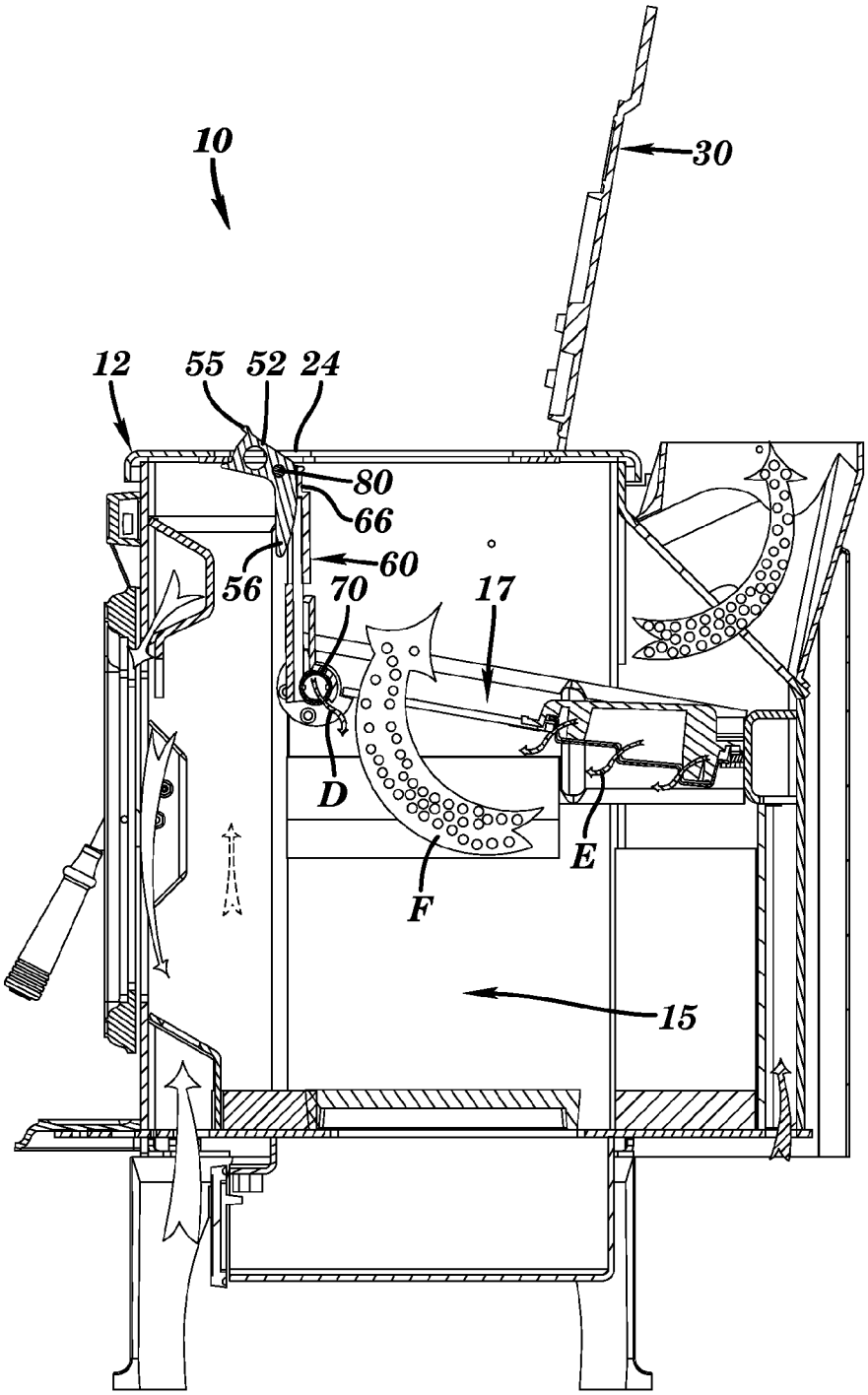
FIG. 6 is a cross-sectional view of the wood fired appliance of FIG. 1 with the top loading door and baffle disposed in an raised opened position.

FIG. 6 is a cross-sectional view of wood fired appliance 10 with top loading door 30 disposed in a raised or open position and baffle 60 disposed in a raised position. The baffle is positionable, e.g., pivoted about the axis, in raised generally vertical position with a second end 66 (extending generally the width of the housing) disposed adjacent to a bottom surface of top wall 24 and defining a second opening 17 (below opening 25 in top wall) for loading wood into the combustion chamber and for directing exhaust gas from the combustion chamber through second opening 17 (as represented by arrow F) and out flue 19. In addition, the secondary air tube may have a plurality of openings along its length for directing a flow of air generally downwardly (as represented by arrow D) along the bottom edge of the baffle between the sides of the housing when the baffle is disposed in a raised position, and for directing a flow of air generally toward the front, as best shown in FIG. 5, which air flow merges with combustion gases as represented by arrow A.

With reference again to FIG. 6, cam 50 may be pivotally attached to top wall 24 of housing 12 via a pin 80. For example, a pair of downwardly-depending supports (not shown in FIG. 4) may extend from the bottom surface of top wall 24 and connect to pin 80. Cam 50 may be generally L-shaped having upper leg 52 and a lower leg 56. Lower leg 56 is engagable with upper end portion 66 of baffle 60. As shown in FIG. 4, upper leg 52 is disposed above a top surface of top wall 24 when baffle 60 is disposed in the raised position and engagable with lower leg 56 of cam 50.

Figure 7:
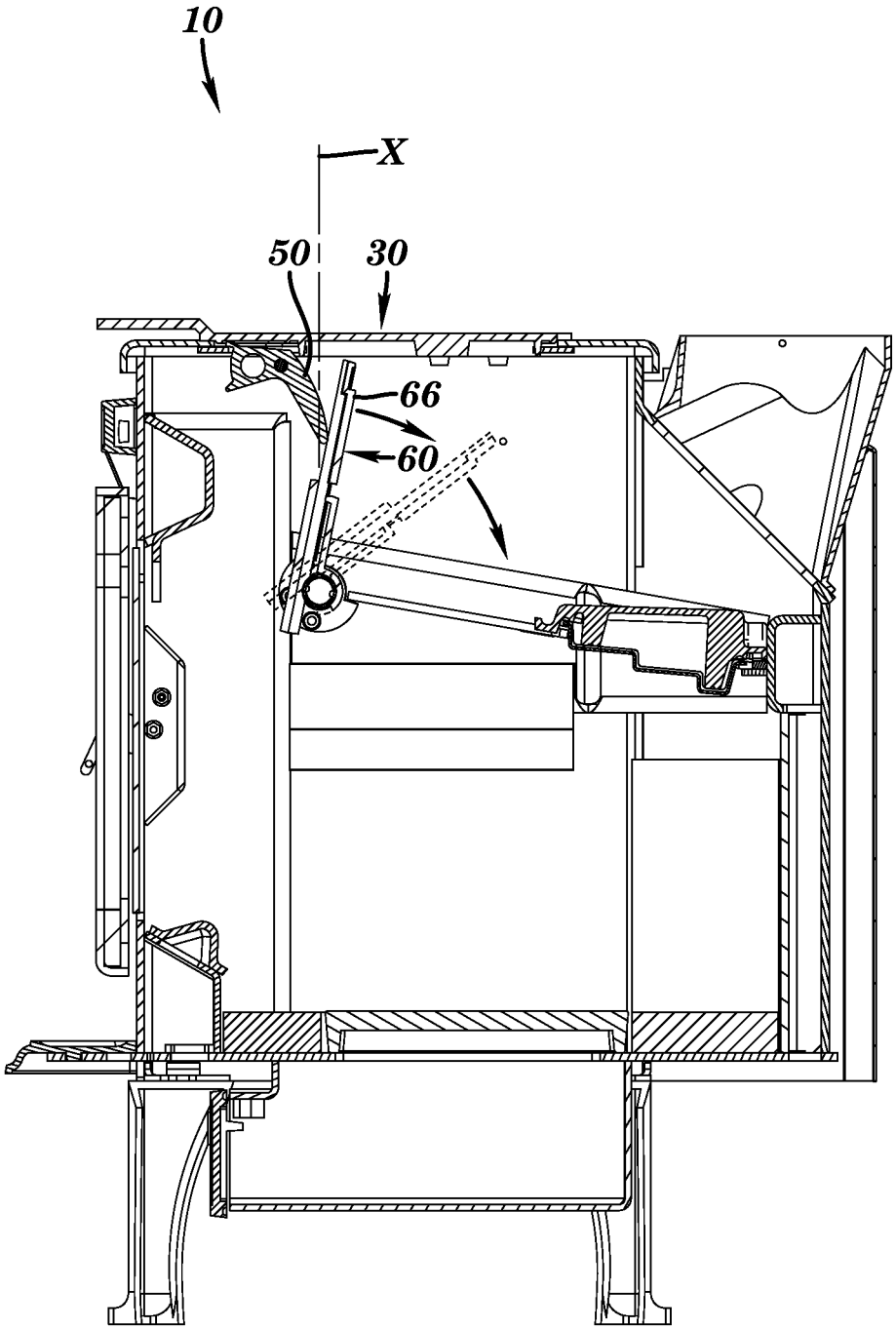
FIG. 7 is a cross-sectional view of the wood fired appliance of FIG. 1 with the top loading door disposed in a closed position and the baffle being tripped by a cam upon the top loading door resting on the top wall of the wood fired appliance to cause the baffle to rotate (as shown in dashed lines) towards a lowered closed position.

With reference to FIG. 7, when an operator of wood fired appliance 10 lowers top loading door 30, the front portion of top loading door 30, as it approaches a horizontal lowered position, engage the upper leg of cam 50, which in turn, causes cam 50 to rotate about the pin, and causes the lower leg to move rearwardly in housing 12 to push upper end 66 of baffle 60 rearwardly, over a center vertical position (defined by vertical dashed line X), so that baffle 60 will continue to rotate, fall under the influence or force of gravity, and rest in the lowered closed position (as best shown in FIG. 5). For example, the cam is rotatable to transform rotary motion of the cam into a generally linear motion, e.g., the lower leg moving the upper end of the baffle rearwardly in the housing. The baffle may be rotatable over an angle greater than 90-degrees between the raised position and the lowered position.

With reference again to FIG. 6, baffle 60 may be attached to the air tube on a side of the air tube resulting in the weight of the baffle being disposed to one side of the axis of rotation when the baffle is disposed in the raised open position and resulting in the baffle remaining in the raised open position when the top loading door is opened and the baffle is raised. As shown in FIG. 6, the baffle may have cutout or relief where the baffle engages the cam, thereby allowing the weigh of the baffle to be disposed to one side of the axis of rotation when the baffle is disposed in the raised open position.

As best shown in FIG. 6, upper leg 52 of cam 50 may include a pair of spaced-apart outwardly extending projections 55 which projections 55 are engagable with a portion of top wall 24 to limit movement of upper leg 52 of cam 50 between the projections. In addition, upper leg 52 of cam 50 may be provided with an apparatus such as a hole to reduce the weight of upper leg 52 compared to lower leg 56 so that when the top loading door is opened and baffle 60 is disposed in a lowered position, upper leg 52 of cam 50 will extend above the top surface of top wall 24.

It will be appreciated by those skilled in the art that the configuration of the above-described wood fired appliances result in a baffle that in its raised open position is tripped by the cam upon closing the top loading door to cause the raised baffle to return by itself or fall under the force of gravity to its lowered or closed position. In other words, upon closing the top loading door, the raised baffle is tipped over or tilted passed a vertical center by the cam to cause the raised baffle to return by itself under the force of gravity to its lowered or closed position. This configuration of the wood fired appliance reduces, if not eliminates, the likelihood of the baffle remaining in a raised position after the loading wood in the wood fired appliance via the top, and closing a top loading door.

Figure 8:
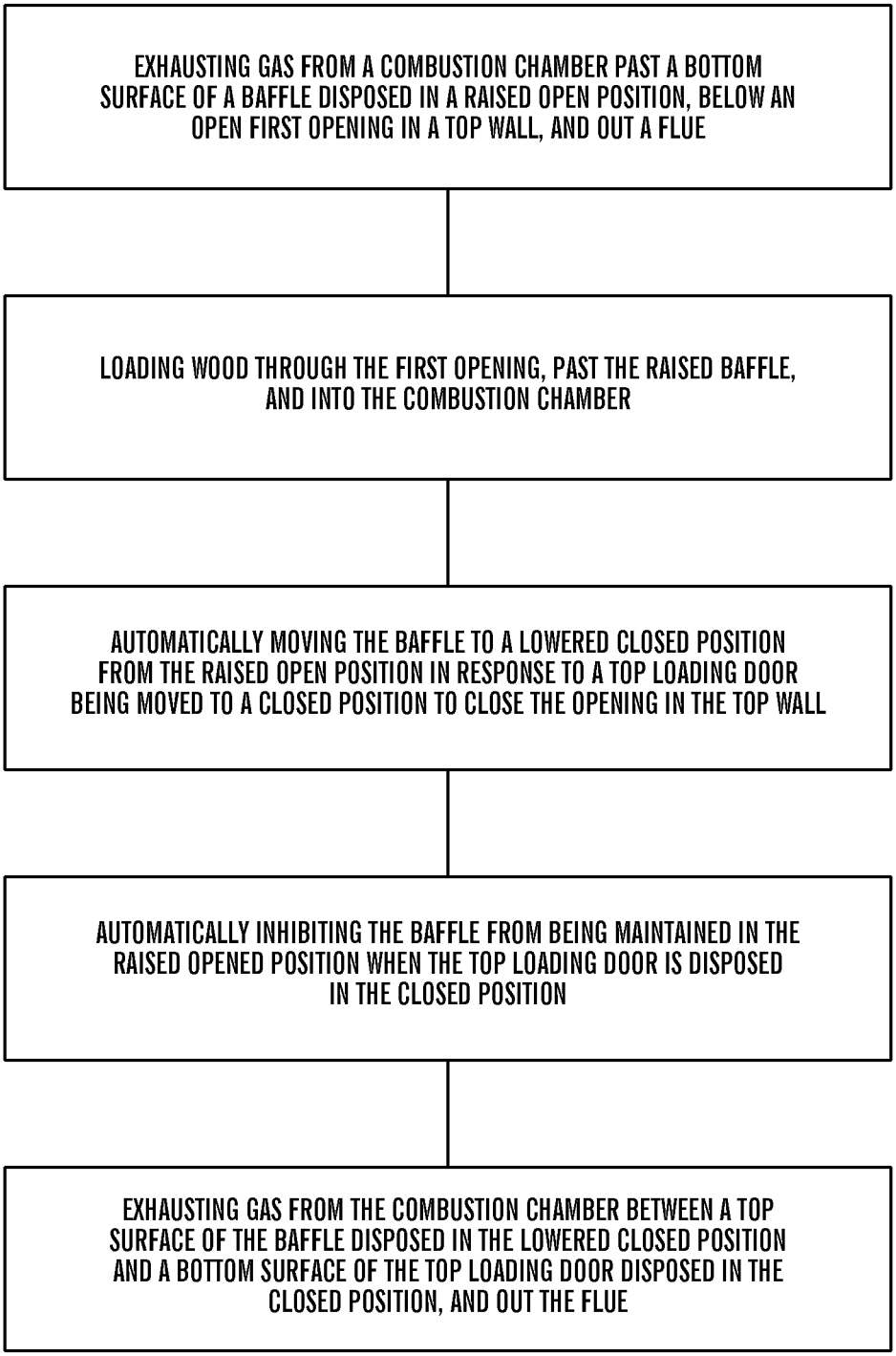
FIGS. 8-10 are three embodiments of methods for operating wood fired appliances to produce heat in accordance with the present invention.
Figure 9:
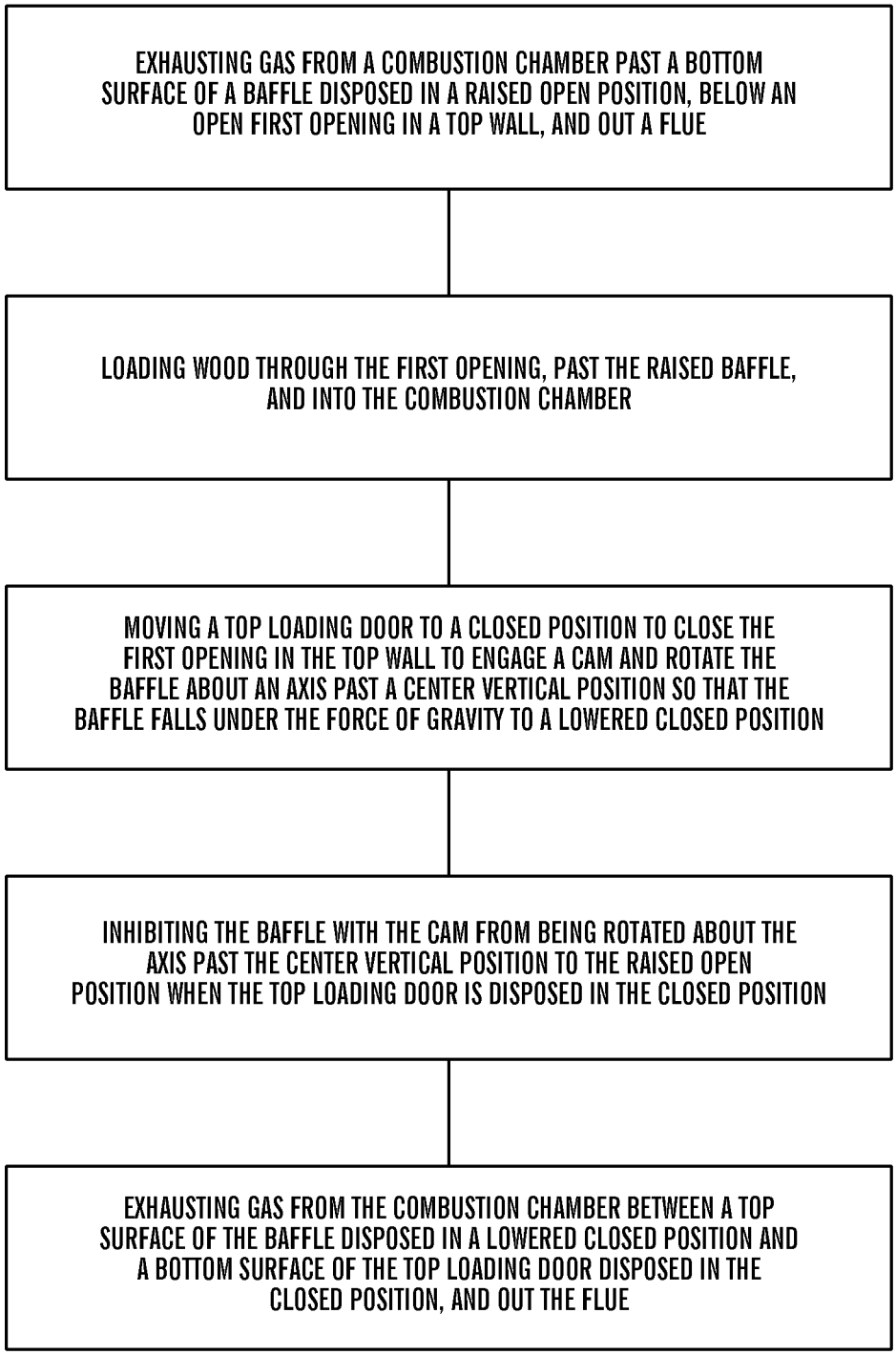
Figure 10:
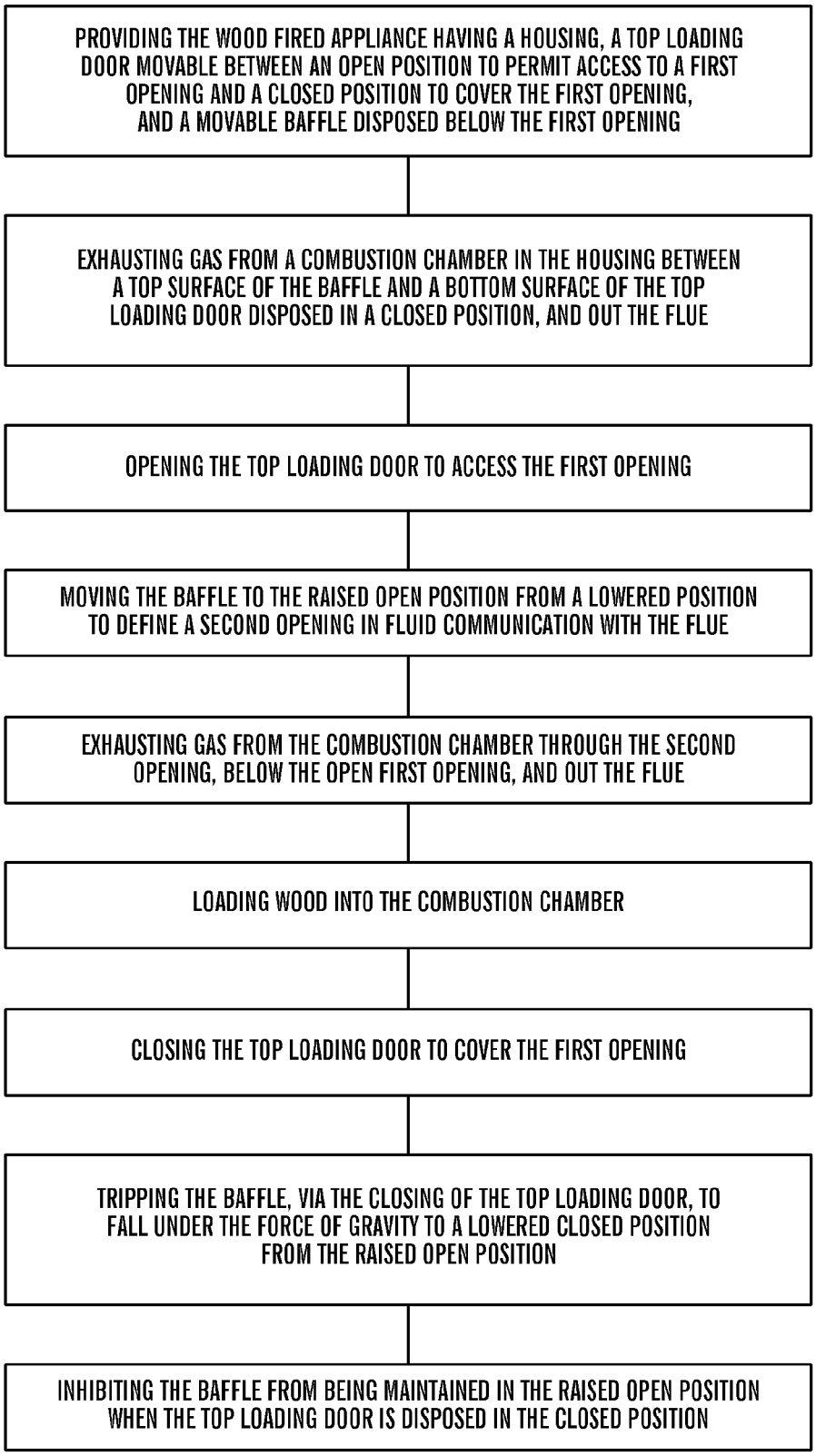

FIGS. 8-10 are three embodiments of methods for operating wood fired appliances to produce heat in accordance with the present invention.

From the present description, it will be appreciated that the technique of the present invention to trip the movable baffle and inhibit the baffle from remaining in the raised open position when the top loading door is lowered to its closed position, may be accomplished in a number of suitable ways. For example, a fixed or movable cam may be attached to the top loading door which upon lowering the top loading door engages the top portion of the baffle to more, deflect, or tip it past a vertical center position, allowing the baffle to fall under the influence of gravity to the baffle's lowered closed position. In another example, a fixed or movable cam may be attached to the baffle. In a further example, instead of the cam rotating about a pivot, the cam may be suitably configured to cause a linear motion for moving or tripping the baffle. While a single-piece cam has been described and illustrated, it will be appreciated that a plurality of member or pieces may be suitably employed for allowing the top loading door and the baffle to cooperate together in accordance with the present invention. While the cam and the baffle are described and illustrated as pivotable about a single axis, it will be appreciated that the cam and/or the baffle may be suitably pivotable about more than one axis. In a further example, instead of the cam rotating about a pivot, the cam may be suitably configured to cause movement in a linear manner for moving or tripping the baffle. In addition, a spring or biasing member may be suitably employed to cause the top loading door and baffle to cooperate in accordance with the aspects of the present invention. In still another example, the door and the baffle may be suitably liked together, e.g., operable with a single handle, to cooperate in accordance with the aspects of the present invention.

Thus, while various embodiments of the present invention have been illustrated and described, it will be appreciated to those skilled in the art that many changes and modifications may be made thereunto without departing from the spirit and scope of the invention.

The invention claimed is:

1. A method for operating a wood fired appliance to produce heat, the method comprising:

exhausting gas from a combustion chamber, past a bottom surface of a baffle disposed in a raised open position, past an open first opening in a top wall, and out a flue;

loading wood through the first opening, past the raised baffle, and into the combustion chamber;

automatically moving the baffle to a lowered closed position from the raised open position in response to a top loading door being moved to a closed position to close the opening in the top wall wherein the top loading door in the closed position engages an upper leg of a cam to rotate a lower leg of the cam, which rotated lower leg engages an upper portion of the baffle in the raised open position to cause the baffle to fall by itself under the force of gravity to the lowered position from the raised open position;

automatically inhibiting the baffle from being maintained in the raised opened position by the rotated lower leg of the cam when the top loading door is disposed in the closed position; and exhausting gas from the combustion chamber between a top surface of the baffle disposed in the lowered closed position and a bottom surface of the top loading door disposed in the closed position, and out the flue.

2. The method of claim 1 wherein the automatically moving the baffle comprises automatically moving the baffle about an axis past a center vertical position.

3. The method of claim 1 wherein the automatically inhibiting the baffle comprises automatically inhibiting the baffle from being moved about an axis past a center vertical position.

4. The method of claim 1 wherein the baffle is pivotable about a first axis, the cam is pivotable about a second axis, and the top loading door is pivotable about a third axis, and wherein the first axis and the second axis being generally vertically aligned, and first axis and the third axis not being vertically aligned.

5. The method of claim 1 wherein the cam is operably disposed adjacent to the top wall.

6. The method of claim 1 wherein the top loading door is pivotally attached to the top wall and an end portion of the top loading door opposite from the pivot axis of the top loading door engages the upper leg of the cam.

7. The method of claim 1 wherein the upper leg of the cam comprises a pair of spaced-apart outwardly extending projections which projections are engagable with the top wall to limit movement of the cam between the projections.

8. The method of claim 1 wherein the automatically moving the baffle comprises rotating the baffle over an angle greater than 90-degrees between the raised open position and the lowered closed position.

9. The method of claim 1 further comprising moving the baffle to the raised open position in a direction upwardly and adjacent to a front of the first opening.

10. The method of claim 1 wherein the automatically moving the baffle comprises automatically pivoting the baffle about an axis disposed below a front portion of the first opening, and the baffle is disposable in the raised position in front of the first opening.

11. The method of claim 1 wherein the baffle is disposable in a generally horizontal lowered closed position and wherein the baffle is disposable in a generally vertical raised open position.

12. The method of claim 1 wherein the baffle is attached to a rotatable secondary air tube manifold.

13. A method for operating a wood fired appliance to produce heat, the method comprising:

exhausting gas from a combustion chamber past a bottom surface of a baffle disposed in a raised open position, past an open first opening in a top wall, and out a flue;

loading wood through the first opening, past the raised baffle, and into the combustion chamber;

moving a top loading door to a closed position to close the first opening in the top wall to engage the top loading door with an upper leg of a cam to rotate a lower leg of the cam, which rotated lower leg of the cam engages an upper end portion of the baffle to move and rotate the baffle about an axis past a center vertical position so that the baffle falls by itself under the force of gravity to a lowered closed position;

inhibiting the baffle, by engagement with the lower leg of the cam, from being rotated about the axis past the center vertical position to the raised open position when the top loading door is disposed in the closed position; and exhausting gas from the combustion chamber between a top surface of the baffle disposed in a lowered closed position and a bottom surface of the top loading door disposed in the closed position, and out the flue.

14. The method of claim 13 wherein the cam is operably disposed adjacent to the top wall.

15. The method of claim 13 wherein the the baffle is pivotable about a first axis, the cam is pivotable about a second axis, and the top loading door is pivotable about a third axis, and wherein the first axis and the second axis being generally vertically aligned, and first axis and the third axis not being vertically aligned.

16. The method of claim 13 wherein the upper leg of the cam comprises a pair of spaced-apart outwardly extending projections which projections are engagable with the top wall to limit movement of the cam between the projections.

17. The method of claim 13 wherein the baffle is rotatable over an angle greater than 90-degrees between the raised open position and the lowered closed position.

18. The method of claim 13 further comprising moving the baffle to the raised open position in a direction upwardly and adjacent to a front of the first opening.

19. The method of claim 13 wherein the baffle is pivotable about an axis disposed below a front portion of the first opening, and the baffle is disposable in the raised position in front of the first opening.

20. The method of claim 13 wherein the baffle is disposable in a generally horizontal lowered position and wherein the baffle is disposable in a generally vertical raised position.

21. The method of claim 13 wherein the baffle is attached to a rotatable secondary air tube manifold.

22. A method for operating a wood fired appliance to produce heat, the method comprising:

providing the wood fired appliance having a housing, a top loading door movable between an open position to permit access to a first opening and a closed position to cover the first opening, and a movable baffle disposed below the first opening;

exhausting gas from a combustion chamber in the housing between a top surface of the baffle and a bottom surface of the top loading door disposed in a closed position, and out a flue;

opening the top loading door to access the first opening;

moving the baffle to a raised open position from a lowered position to define a second opening for loading wood past the baffle into the combustion chamber, said second opening in fluid communication with the flue;

exhausting gas from the combustion chamber through the second opening, past a bottom surface of the baffle disposed in the raised open position, past the open first opening, and out the flue;

loading wood into the combustion chamber;

closing the top loading door to cover the first opening;

tripping the baffle, via the closing of the top loading door to engage an upper leg of a cam so that a lower leg of the cam engages the baffle so that the baffle falls by itself under the force of gravity to a lowered closed position from the raised open position;

inhibiting the baffle from being maintained in the raised open position when the top loading door is disposed in the closed position; and wherein the baffle is pivotable about a first axis, the cam is pivotable about a second axis, and the top loading door is pivotable about a third axis, and wherein the first axis and the second axis being generally vertically aligned, and first axis and the third axis not being vertically aligned.

23. The method of claim 22 wherein the tripping the baffle comprises rotating the baffle about an axis past a vertical center position, and the inhibiting comprises inhibiting the baffle from being moved about the axis past the vertical center position when the top loading door is disposed in the closed position.

24. The method of claim 22 wherein the cam is pivotally attached to the housing.

25. The method of claim 22 wherein the tripping the baffle comprises engaging the top loading door with an upper leg of the cam which rotates the cam and a lower leg which is engagable with an upper end portion of the baffle.

26. The method of claim 25 wherein the upper leg of the cam comprises a pair of spaced-apart outwardly extending projections which projections are engagable with a top wall to limit movement of the cam between the projections.

27. The method of claim 22 wherein the moving the baffle to the raised open position from the lowered closed position comprises rotating the baffle over an angle greater than 90-degrees between the raised open position and the lowered closed position.

28. The method of claim 22 wherein the moving the baffle to the raised open position comprises moving an end of the baffle in a direction upwardly and adjacent to a front of the first opening in the housing.

29. The method of claim 22 wherein the baffle is pivotable about the first axis disposed below a front portion of the first opening, and the baffle is disposable in the raised open position in front of the first opening in the housing.

30. The method of claim 22 wherein the baffle is disposable in a generally horizontal lowered position and wherein the baffle is disposable in a generally vertical raised position.

31. The method of claim 22 wherein the baffle is attached to a rotatable secondary air tube manifold.

* * * * *